US005103540A

United States Patent [19]

Hirasawa

[11] Patent Number: 5,103,540

[45] Date of Patent: Apr. 14, 1992

[54] APPARATUS FOR GAPPING A STRINGER CHAIN

[75] Inventor: Masanori Hirasawa, Kurobe, Japan

[73] Assignee: Yoshida Kogyo K. K., Tokyo, Japan

[21] Appl. No.: 733,162

[22] Filed: Jul. 19, 1991

[51] Int. Cl.[5] ..... B21D 53/50; A41H 37/06

[52] U.S. Cl. ..... 29/33.2; 29/770; 83/921

[58] Field of Search ..... 29/33.2, 34 A, 408, 29/410, 770, 766; 83/620, 921

[56] References Cited

U.S. PATENT DOCUMENTS

| | | | |
|---|---|---|---|
| 3,611,545 | 10/1971 | Takamatsu | 29/33.2 X |
| 3,958,319 | 5/1976 | Takamatsu | 29/408 X |
| 4,573,383 | 3/1986 | Matsumoto | 29/33.2 X |
| 4,866,825 | 9/1989 | Suzuki | 29/33.2 |

FOREIGN PATENT DOCUMENTS

| | | | |
|---|---|---|---|
| 2113295 | 8/1983 | United Kingdom | 29/408 |
| 2150214 | 6/1985 | United Kingdom | 29/408 |

*Primary Examiner*—William Briggs

*Attorney, Agent, or Firm*—Hill, Van Santen, Steadman & Simpson

[57] ABSTRACT

An apparatus for gapping a stringer chain at predetermined intervals is disclosed, which comprises an anvil and a cutter cooperating therwith in cutting a length of coupling elements on a pair of support tapes. The cutter includes a vertically movable punch which is provided with a plurality of positioning prongs adapted to engage in between adjacent elements and hold the stringer chain firmly in place during gapping thereof.

3 Claims, 5 Drawing Sheets

APPARATUS FOR GAPPING A STRINGER CHAIN

BACKGROUND OF THE INVENTION

1. Field of the Invention

This invention relates to an apparatus for gapping an elongate stringer chain at predetermined intervals to be assembled with various slide fastener component parts.

2. Prior Art

Generally, a substantially endless elongated stringer chain comprising a pair of support tapes and rows of coupling elements secured to the respective tapes is cut successively to predetermined lengths to provide individual slide fasteners. Prior to cutting, it has been a common practice to gap the stringer chain to form element-free portions or gaps at predetermined intervals along the inner longitudinal edges of the stringer chain, the gaps being utilized for mounting various slide fastener component parts such as sliders, bottom end stops and top end stops. The element-free portions or gaps of the stringer chain are formed by removing a predetermined number of coupling elements by means of a cutting tool having an operative edge length corresponding to a pre-calculated gap length. For one reason or another, the cutter would leave some of the endmost coupling elements half or partly cut away at either or both of the leading and trailing ends of the gaps, with resultant uncut debris interfering with a subsequent parts applying operation. To eliminate this problem, it has been proposed, as disclosed for example in Japanese Laid-Open Utility Model Publications 53-16713 and 63-31611, to provide a positioning pawl or pin adjacent to each of the leading and trailing ends of a cutter for engaging the coupling elements and thus setting the stringer chain up in position for gapping by the cutter. Since such positioning pawls or pins are spaced apart from each other by a distance greater than the operative length of the cutter, it would often occur that the number of coupling elements actually existing between the respective positioning pawls or pins differs from a predetermined number of coupling elements to be removed to provide gaps of a predetermined length. This discrepancy is believed attributable to changes in the tension exerted longitudinally of the stringer chain during feeding thereof, or dimensional errors of the coupling elements. The resultant gaps therefore would often carry irregularly severed endmost coupling elements differing in shape between those in one row and those in the other row on the respective support tapes, rendering it difficult to fit properly in place such component parts as top and bottom end stops particularly separable end stops.

SUMMARY OF THE INVENTION

With the foregoing difficulties of the prior art in view, the present invention seeks to provide an apparatus for gapping a stringer chain for slide fastener having a pair of opposed support tapes and respective rows of coupling elements secured thereon, which apparatus incorporates operating structural features designed to gap the stringer chain at predetermined intervals along its length to provide element-free portions or gaps having such endmost or terminal coupling elements at their opposite ends which are cut neatly, substantially symmetrically and at the same position throughout a series of gaps.

The above and other features and advantages of the invention will appear clear from the following detailed description taken with reference to the accompanying drawings.

DETAILED DESCRIPTION OF THE INVENTION

Figure 1:
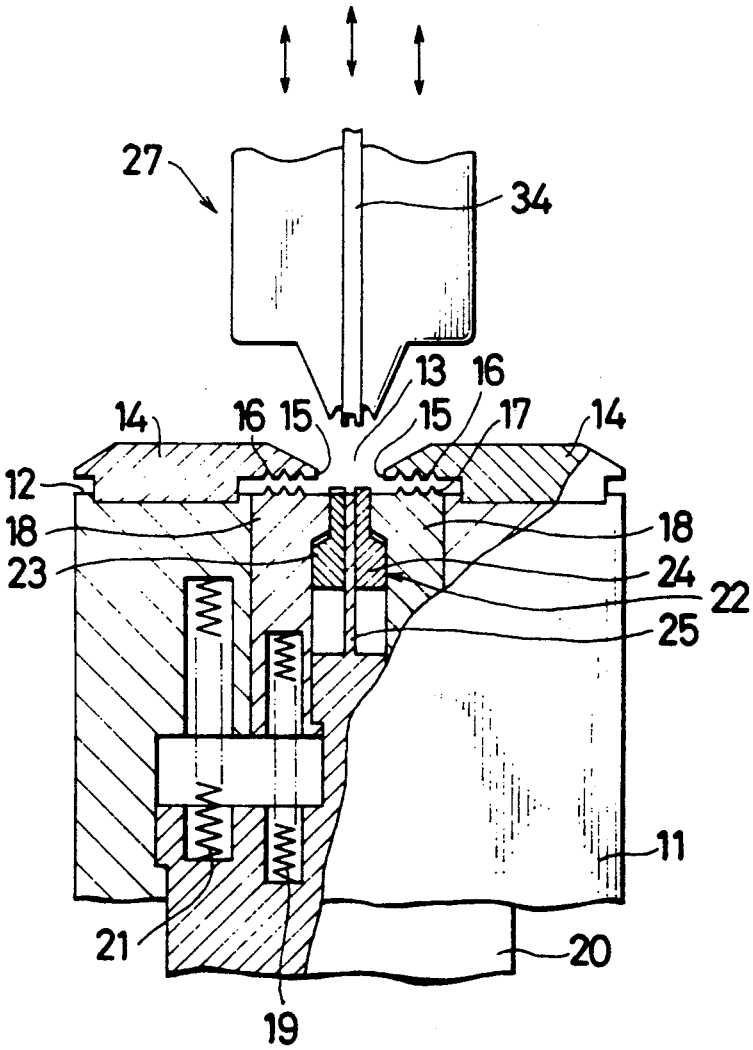
FIG. 1 is a side elevational, partly sectional view of a gapping apparatus embodying the invention.
Figure 8:
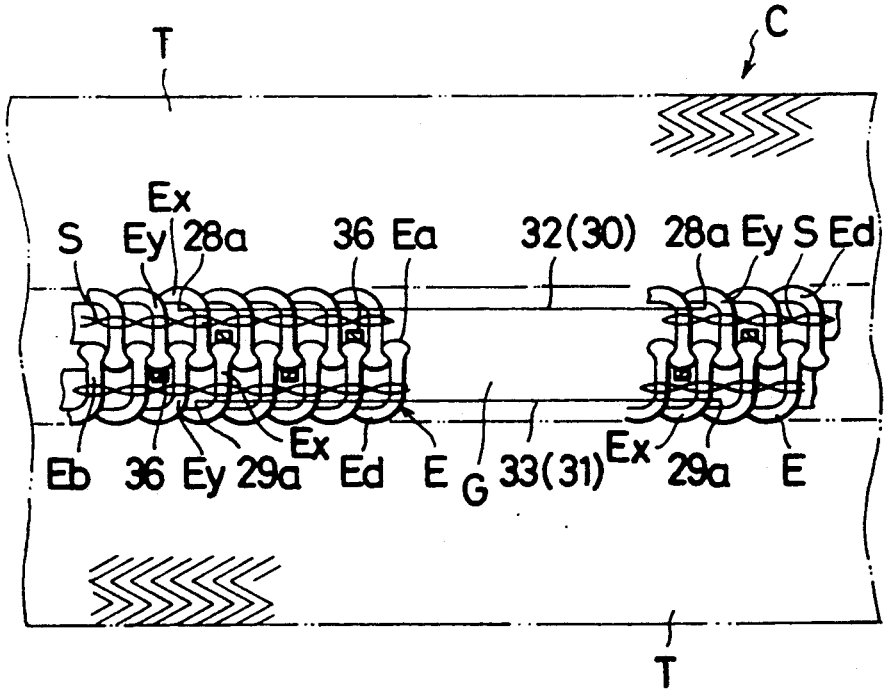
FIG. 8 is a segmentary plan view on enlarged scale of a stringer chain.

Referring now to the drawings and FIG. 1 in particular, there is shown a gapping apparatus 10 provided in accordance with the invention, which apparatus generally comprises a machine frame 11 having on its top surface a working table 12 centrally defining a horizontal path of travel 13 for a slide fastener stringer chain C to follow. The term stringer chain C is used to designate a pair of oppositely disposed support tapes T, T each carrying along their respective inner longitudinal edges a row of continuous coupling elements E of a helical coil structure which is secured in place typically by sewing threads S passing through cords R that extend longitudinally through the coil structure as shown in FIG. 8, or which may be alternatively woven from a filamentary material into the respective tapes simultaneously as the latter are woven as is well known in the art. Each of the individual coupling element E consists of a coupling head Ea, an upper leg Eb, a lower leg Ec and a heel Ed interconnecting between neighboring coupling elements.

The apparatus 10 includes a pair of clamping jaws 14, 14 secured on the table 12 and having inner edges 15 confronting across a gap slightly larger in width than the two opposed rows of coupling elements E that are coupled together. The clamping jaws 14, 14 each have a plurality of grooves 16 engageable with corresponding ridges 17 formed on a pair of pressure pads 18, 18 which are vertically movable toward and away from the path 13 of the stringer chain C. When brought to a stop at a predetermined position on the table 12, the stringer chain C is clamped in place between the jaws 14 and the pressure pads 18 so that the chain C is prepared for a gapping operation later described. The pressure pads 18, 18 are connected by a first spring 19 to a holder 20 vertically movably supported in the frame 11. The holder 20 is driven by a pneumatic cylinder or the like not shown to move upwardly, compressing the spring 19 with which to move the pressure pads 18 up into engagement with the clamping jaws 14.

A second spring 21 is interposed between the frame 11 and the holder 20 for biasing the holder 20 downwardly as it descends.

An anvil 22 consists of a pair of die blocks 23, 24 having a knock-out plate 25 movably supported therebetween. The anvil 22 is accommodated in the pressure pads 18 and secured to the frame 11.

Figure 2:
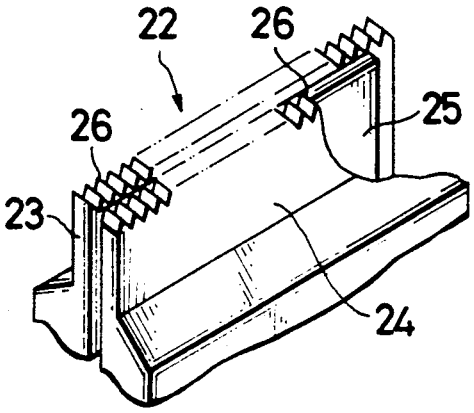
FIG. 2 is a perspective view on enlarged scale of an anvil provided in the apparatus of FIG. 1.
Figure 3:
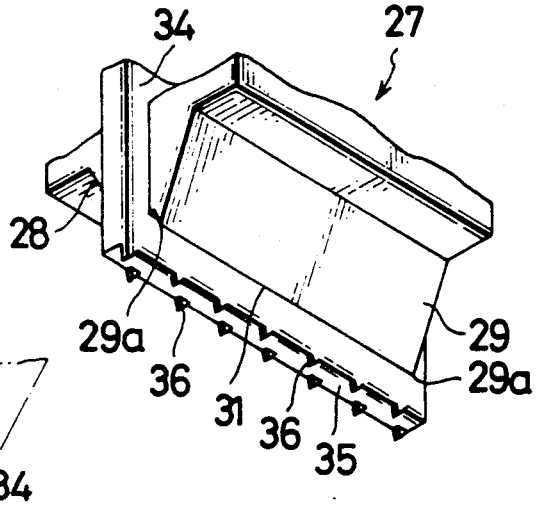
FIG. 3 is a perspective view on enlarged scale of a cutter operatively associated with the anvil.
Figure 4:
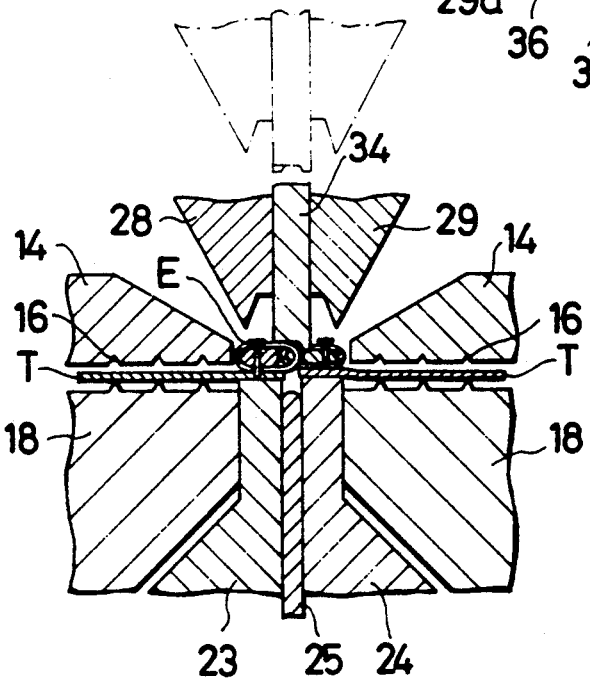
FIG. 4 is a transverse cross-sectional view on enlarged scale of the apparatus showing the cutter and the anvil in one stage of operation.
Figure 7:
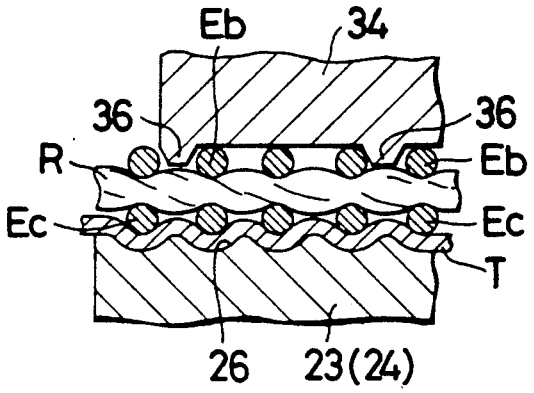
FIG. 7 is a diagrammatic segmentary side elevational view on enlarged scale of a punch and the anvil with a stringer chain interposed therebetween.

As shown in FIGS. 2 and 7, each of the die blocks 23, 24 has formed on its top surface a plurality of transverse guide grooves 26 each dimentioned to fittingly receive the lower leg Ec of the coupling element E on the support tape T. The guide grooves 26 in one die block 23 are shifted a half pitch apart from those in the other die block 24.

A cutter 27 is vertically movable by a suitable drive not shown toward and away from the anvil 22, and has a pair of blades 28, 29 whose cutting edges 30, 31 are spaced apart by a distance such that they overlie the upper legs Eb of the respective elements E adjacent to the respective heels Ed. The blades 28, 29 each have a length corresponding to a gap G to be formed at predetermined intervals in the stringer chain C and have their respective terminal ends 28*a*, 29*a* displaced relative to each other by one upper leg Eb or a half pitch of the element E as indicated by solid lines 32, 33 in FIG. 8 such that the terminal or endmost coupling elements Ex on the respective tapes T, T can be cut across their legs Eb merging with the heels Ed.

A punch 34 is supported centrally in the body of the cutter 27 and vertically movable relative thereto by means not shown toward and away from the anvil 22, more specifically in vertical alignment with the knock-out plate 25. The punch 34 is provided on its lower or operative end surface 35 with two rows of saw-tooth like positioning prongs 36 displaced relative to each other by a half pitch of the upper legs Eb of the elements E and distributed in spaced relation to span over a few (presently illustrated to be every three) upper legs Eb of the coupling elements and engage between adjacent upper legs Eb as better shown in FIG. 7. The operative length of the punch 34 is substantially equal to or slightly greater than the cutter blades 28, 29 depending upon the mode of gapping operation.

Figure 5:
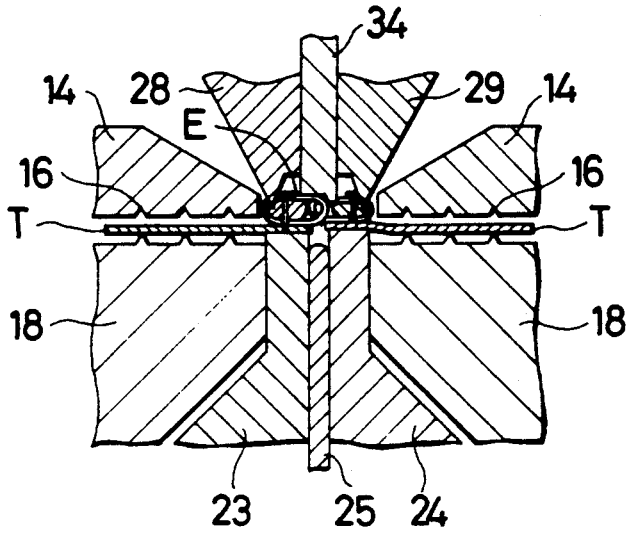
FIG. 5 is a view similar to FIG. 4 but showing the cutter and the anvil in another stage of operation.
Figure 6:
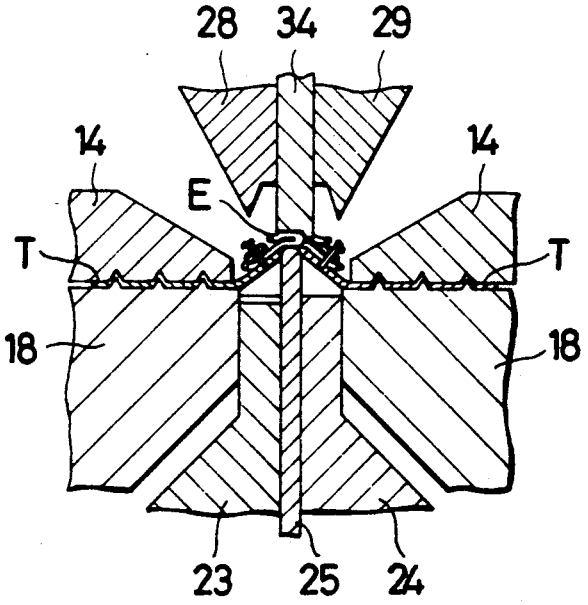
FIG. 6 is a view similar to FIG. 4 but showing the cutter and the anvil in a further stage of operation.

With this construction, the gapping apparatus 10 operates as follows. The stringer chain C, while being advanced intermittently, is stopped at a predetermined position on the path of travel 13, when the holder 20, pressure pads 18, anvil 22 and knock-out plate 25 are all retracted downwardly in their respective non-operative positions, with the cutter 27 and punch 34 likewise held in raised non-operative position. In this instance, the stringer chain C is still held free from being clamped or gripped between the clamping jaws 14, 14 and the pressure pads 18, 18 so as to permit the stringer chain C to flexibly move longitudinally a small distance required for the positioning prongs 36 to adjustably fit in between adjacent upper legs Eb of the coupling elements E. Otherwise, the positioning prongs 36 would often ride over and get stuck directly on the upper legs Eb of the elements E in the event that the stringer chain C is shifted out of the proper operative position on the working table 12, or the coupling elements E are mounted with irregular pitch on the respective tapes T, T. Such errors may be detected by a sensor such as a microswitch not shown provided at the drive for the punch 34 so that the punch 34 may be repeatedly moved up and down until the positioning prongs 36 find their way into the spaces between adjacent upper legs Eb of the elements as depicted in FIG. 7. This is followed by ascending movement of the pressure pads 18, 18 to clamp the stringer chain C in place on table 12 in cooperation with the clamping jaws 14, 14. During descending movement of the punch 34, the cutter 27 may be arranged to stay in retracted position or may also move downwardly to a position closely above the rows of coupling elements E. Simultaneously with pressure engagement of the punch 34 with the stringer chain C, the die blocks 23, 24 ascend until the guide grooves 26 therein receive and support the lower legs Ec of the elements from the lower surface of each of the tapes T, T, thus firmly holding the stringer chain C in proper position ready for gapping as shown in FIG. 7. The cutter 27 is now actuated to come down into engagement with and cut the upper legs Eb over a predetermined length of the stringer chain C as shown in FIG. 5, in which instance the blades 28, 29 are disposed with their respective terminal ends 28*a*, 29*a* substantially registering with the upper legs Eb adjacent to the heel portions Ed of the endmost elements Ex on the respective tapes T, T as shown in FIG. 8. This ensures freedom of those neighbouring coupling elements Ey immediately adjoining the endmost elements Ex from being inadvertently cut or impaired by the cutter 27. The length of the coupling elements E which has been cut is removed from the stringer chain C by the knock-out plate 25 as the latter makes a further upward movement clear across the level of the horizontal path of travel 13 as shown in FIG. 6, thereby providing an element-free portion or gap G at predetermined intervals longitudinally along the stringer chain C for subsequent mounting of the slide fastener component parts in a manner well known in the art.

Figure 9:
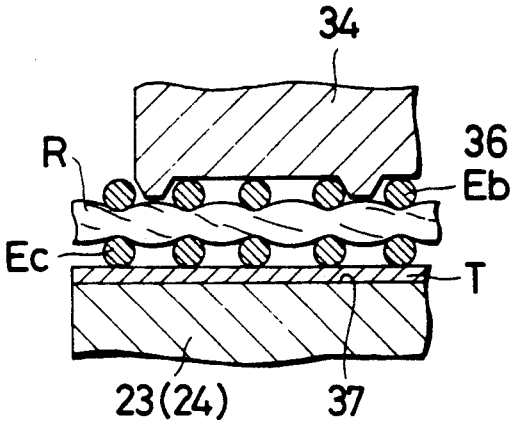
FIG. 9 is a diagrammatic segmentary side elevational view of a modified form of a punch-anvil combination.

FIG. 9 shows a modification in which the die block 23 (24) has a flat top surface 37 devoid of guide grooves 26.

Figure 10:
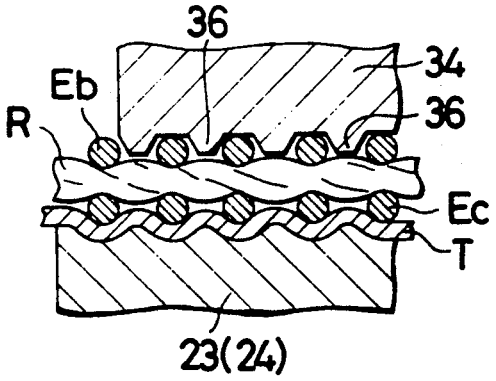
FIG. 10 is a view similar to FIG. 9 but showing another modified form of a punch-anvil combination.

FIG. 10 shows another modification in which the punch 34 has as many positioning prongs 36 as to engage between each adjacent upper leg Eb of the coupling elements E.

Many other modifications and changes may be made in the apparatus 10 herein advanced, without departing from the scope of the appended claims.

What is claimed is:

1. An apparatus for gapping a stringer chain for slide fastener having a pair of support tapes each carrying a row of coupling elements, each of said elements consisting of a head, an upper leg, a lower leg and a heel, which apparatus comprises:

(a) an anvil consisting of a pair of die blocks having a knock-out plate movably supported therebetween;

(b) a vertically movable cutter having a pair of spaced blades and adapted to cooperate with said anvil for cutting a length of said coupling elements; and (c) a punch supported in and movable relative to said cutter, said punch having two rows of positioning prongs engageable in between adjacent upper legs of the coupling elements and said blades having their respective terminal ends displaced relative to each other by a distance corresponding to one upper leg or a half element pitch.

2. An apparatus according to claim 1 wherein each of said die blocks has a plurality of guide grooves for receptive engagement with the lower legs of the coupling elements and cooperating with said positioning prongs in holding said stringer chain firmly in place during gapping thereof.

3. An apparatus according to claim 1 wherein said positioning prongs are in the form of a sawtooth.

* * * * *